US007160480B2

(12) United States Patent
Liu et al.

(10) Patent No.: US 7,160,480 B2
(45) Date of Patent: Jan. 9, 2007

(54) LEATHER TREATED WITH FLUOROCHEMICALS

(75) Inventors: Andrew Hen Liu, Newark, DE (US); Kai-Volker Schubert, Chadds Ford, PA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 11/063,202

(22) Filed: Feb. 22, 2005

(65) Prior Publication Data

US 2006/0186368 A1 Aug. 24, 2006

(51) Int. Cl.
*C14C 9/00* (2006.01)
*C14C 9/02* (2006.01)
*C14C 3/00* (2006.01)

(52) U.S. Cl. ..... 252/8.57; 8/94.1 R; 8/94.19 R; 8/94.33; 427/389; 428/540

(58) Field of Classification Search ..... 252/8.57; 8/94.1 R, 94.19 R, 94.33; 428/540; 427/389
See application file for complete search history.

(56) References Cited

U.S. PATENT DOCUMENTS

| | | | | |
|---|---|---|---|---|
| 2,803,615 | A | 8/1957 | Ahlbrecht et al. | |
| 3,010,780 | A | 11/1961 | Heyden et al. | |
| 3,019,133 | A | 1/1962 | Heyden et al. | |
| 3,052,571 | A | 9/1962 | Fletscher et al. | |
| 3,236,672 | A | 2/1966 | Shane et al. | |
| 3,484,281 | A | 12/1969 | Guenthner et al. | |
| 3,573,952 | A * | 4/1971 | Berger | 427/184 |
| 3,574,518 | A * | 4/1971 | Detomaso | 8/94.21 |
| 3,839,373 | A | 10/1974 | Jaeger | |
| 3,860,613 | A | 1/1975 | Jaeger | |
| 3,919,183 | A | 11/1975 | Jager et al. | |
| 3,923,715 | A | 12/1975 | Dettre et al. | |
| 3,951,762 | A | 4/1976 | Voss et al. | |
| 4,029,585 | A | 6/1977 | Dettre et al. | |
| 4,325,857 | A | 4/1982 | Champaneria et al. | |
| 4,527,992 | A | 7/1985 | Friese et al. | |
| 4,595,518 | A | 6/1986 | Raynolds et al. | |
| 4,668,406 | A | 5/1987 | Chang | |
| 4,709,074 | A * | 11/1987 | Bathelt et al. | 560/33 |
| 4,778,915 | A | 10/1988 | Lina et al. | |
| 4,873,306 | A * | 10/1989 | Wehowsky et al. | 528/28 |
| 4,877,540 | A | 10/1989 | Engelhardt et al. | |
| 4,999,024 | A | 3/1991 | Scheen | |
| 5,045,624 | A | 9/1991 | Falk et al. | |
| 5,100,954 | A * | 3/1992 | Itoh et al. | 524/805 |
| 5,171,877 | A | 12/1992 | Knaup et al. | |
| 5,276,175 | A | 1/1994 | Dams et al. | |
| 5,292,796 | A | 3/1994 | Dams et al. | |
| 5,370,919 | A | 12/1994 | Fieuws et al. | |
| 5,453,540 | A | 9/1995 | Dams et al. | |
| 5,489,389 | A | 2/1996 | Ritter et al. | |
| 5,548,022 | A | 8/1996 | Ito et al. | |
| 5,669,964 | A | 9/1997 | Kai | |
| 5,693,747 | A | 12/1997 | Deisenroth et al. | |
| 5,714,082 | A | 2/1998 | Boardman et al. | |
| 5,885,474 | A * | 3/1999 | Reiners et al. | 252/8.57 |
| 5,972,037 | A | 10/1999 | Scheen | |
| 6,048,952 | A | 4/2000 | Behr et al. | |
| 6,251,984 | B1 | 6/2001 | Shimada et al. | |
| 6,353,051 | B1 | 3/2002 | Huang | |
| 6,479,612 | B1 | 11/2002 | Del Pesco et al. | |
| 6,525,127 | B1 | 2/2003 | Jariwala et al. | |
| 6,664,354 | B1 | 12/2003 | Savu et al. | |
| 6,734,154 | B1 | 5/2004 | Flynn et al. | |
| 6,803,109 | B1 | 10/2004 | Qiu et al. | |
| 6,827,041 | B1 | 12/2004 | Hague et al. | |
| 2003/0001130 | A1 | 1/2003 | Qui | |
| 2003/0204015 | A1 | 10/2003 | Burleigh et al. | |
| 2004/0024262 | A1 | 2/2004 | Jariwala et al. | |

FOREIGN PATENT DOCUMENTS

| | | |
|---|---|---|
| DE | 3607773 | 9/1987 |
| DE | 4423352 A | 1/1996 |
| EP | 0 140 525 B2 | 5/1985 |
| EP | 0 339 862 A | 2/1989 |
| EP | 0 692 566 B1 | 5/1995 |
| EP | 0 761 823 B1 | 11/1995 |
| EP | 0 690 039 A | 1/1996 |
| EP | 0 717 057 A | 6/1996 |
| FR | 2 749 309 A1 | 12/1997 |
| GB | 1296255 | 11/1972 |
| GB | 1304992 | 1/1973 |
| JP | 59109574 A | 6/1984 |
| JP | 03265700 A | 11/1991 |
| JP | 05214325 A | 8/1993 |
| JP | 06017034 A | 1/1994 |
| WO | WO 97/00995 | 1/1997 |
| WO | WO 97/05288 | 2/1997 |
| WO | WO 97/44375 | 11/1997 |
| WO | WO 98/51727 | 11/1998 |

(Continued)

OTHER PUBLICATIONS

Dupont Company brochure entitled QUILON® *Chrome Complexes For Release and Surface Treatment Properties, Uses, Storage and Handling*; undated.

*Primary Examiner*—Anthony J. Green

(57) ABSTRACT

A method of treating leather for imparting soil resistance to the leather by contacting the leather with a fluorinated hydrophobic additive comprising at least one fluorinated urethane or a mixture of at least one fluorinated urethane with at least one fluorinated ester, and the resulting treated leather having soil resistance are disclosed.

16 Claims, No Drawings

FOREIGN PATENT DOCUMENTS

| | | | |
|---|---|---|---|
| WO | WO 2000061697 | A1 | 10/2000 |
| WO | WO 01/10922 | A1 | 2/2001 |
| WO | WO 01/030873 | | 5/2001 |
| WO | WO 02/072537 | A2 | 9/2002 |
| WO | WO 03/089712 | | 10/2003 |
| WO | WO 2004/013089 | | 2/2004 |

* cited by examiner

LEATHER TREATED WITH FLUOROCHEMICALS

FIELD OF THE INVENTION

This invention relates to a method for imparting soil resistance to leather, and to the resulting treated leather having such soil resistance.

BACKGROUND OF THE INVENTION

The tanning of leather is a complex process described, for instance, in the Kirk-Othmer Encyclopedia of Chemical Technology. Fourth Edition, Volume 15, pp. 159–176. The vegetable, inorganic, and synthetic tanning processes are described in a review "Practical leather Technology, T. C. Thorstensen (4$^{th}$ Ed., 1993, Krieger Publishing Company, Malabar Fla.). Produced from animal skins, leather is used for many purposes, including shoes, upholstery, clothing, gloves, hats, books, sports equipment, and the like. In most such uses, water repellency is desired and conventionally achieved by the application of fats, or by surface treatment of the leather after drying. For example, various hydrophobes, such as silicone treatments and fluorinated esters, have been applied to leather to provide water repellency. Silicones, while hydrophobic, are oleophilic and thus, while providing water repellency, tend to increase soiling.

A number of treatment processes have been described for improving the water- and oil-repellency of leather, for instance, Diesenroth, et al, in U.S. Pat. No. 5,693,747 describe sulfur-containing diols capable of being reacted with urethanes to make repellent materials. Del Pesco et al., in U.S. Pat. No. 6,479,612, describe a polymer having at least one urea linkage derived by contacting (1) at least one polyisocyanate, or mixture of polyisocyanates, (2) at least one fluorocarbon alcohol, fluorocarbon thiol or fluorocarbon amine, (3) at least one straight or branched chain alcohol, amine or thiol, and (4) at least one alcohol containing a sulfonic acid group or its salt, and then (5) optionally at least one linking agent useful for imparting oil repellency and water repellency to substrates. However, these compositions do not address soil resistance.

The cleaning of such conventionally produced leathers can be difficult or impossible because leathers made by conventional tanning processes do not stay soft and compliant when wetted with water or water- based solutions of the type used for washing traditional woven fabrics. Instead, when wetted, leather products exhibit a tendency to become stiff and/or brittle as they dry with cracks or splits often occurring. As a result, cleaning techniques for leather have generally been limited. Some leather may be cleaned by relatively costly dry cleaning processes employing organic solvents. Recent tanning processes, such as that of U.S. Pat. No. 5,972,037 of Scheen, produce machine washable and machine dryable leather cleanable in typical household appliances. For all leathers, resistance to soiling and staining would improve ease in caring for the leather.

Therefore, it is desirable to provide a method of imparting soil resistance to leather. Furthermore, it is desirable that the treatment agents employed be effective with essentially no changes in the leather processing and tanning steps, be compatible with leather treatment bath formulations, and be applied without the need for additional equipment. The present invention provides such a method.

SUMMARY OF THE INVENTION

The present invention comprises a method of imparting soil resistance to leather comprising contacting said leather during tanning with a fluorinated hydrophobic additive comprising at least one fluorinated urethane or a mixture of at least one fluorinated urethane and at least one fluorinated ester.

The present invention further comprises a leather treated to provide soil resistance by contacting said leather during tanning with a fluorinated hydrophobic additive comprising at least one fluorinated urethane or a mixture of at least one fluorinated urethane and at least one fluorinated ester.

DETAILED DESCRIPTION

Tradenames are shown herein in upper case.

The term "leather", as used herein, includes both conventional and washable leather.

The present invention comprises a method of imparting soil resistance properties to leather comprising contacting said leather during tanning with a fluorinated hydrophobic additive comprising a fluorinated urethane or a mixture of a fluorinated urethane and fluorinated ester. An aqueous dispersion of at least one fluorinated hydrophobic additive is added to the tanning bath during tanning of the leather. The resulting leathers of the present invention have durable soil-resistance. Soil resistance is distinct from repellency. A leather may have excellent repellency, but be very poor in soil resistance. Thus soil resistance is in demand for ease of care of leather.

The fluorinated hydrophobic additives useful in the practice of the present invention are fluorinated urethanes, and mixtures of fluorinated urethanes with fluorinated esters.

Examples of fluorinated urethanes suitable for use herein include, but are not limited to, the polymers described by Del Pesco et al., in U.S. Pat. No. 6,479,612. These polymers have at least one urea linkage derived by contacting (1) at least one polyisocyanate, or mixture of polyisocyanates, (2) at least one fluorocarbon alcohol, fluorocarbon thiol or fluorocarbon amine, (3) at least one straight or branched chain alcohol, amine or thiol, and (4) at least one alcohol containing a sulfonic acid group or its salt, and then (5) optionally at least one linking agent. The fluorinated urethanes are used in the present invention in the form of an aqueous dispersion, typically containing from about 10% to about 35% of fluorinated urethane solids based on the weight of the dispersion.

The polyisocyanate reactant (Reactant 1) provides the backbone of the polymer. Any polyisocyanate having predominately three or more isocyanate groups, or any isocyanate precursor of a polyisocyanate having predominately three or more isocyanate groups, is suitable for use in this invention. It is recognized that minor amounts of diisocyanates may remain in such products. An example of this is a biuret containing residual small amounts of hexamethylene diisocyanate. Particularly preferred as Reactant 1 are hexamethylene diisocyanate homopolymers commercially available, for instance as DESMODUR N-100 from Lanxess Corporation, Pittsburgh Pa.

Also suitable for use as Reactant 1 are hydrocarbon diisocyanate-derived isocyanurate trimers. Preferred is DESMODUR N-3300 (a hexamethylene diisocyanate-based isocyanurate also available from Lanxess Corporation, Pittsburgh, Pa.). Other triisocyanates useful for the purposes of this invention are those obtained by reacting three moles of toluene diisocyanate with 1,1,1-tris-(hydroxymethyl)ethane or 1,1,1-tris-(hydroxymethyl)propane. The isocyanurate trimer of toluene diisocyanate and that of 3-isocyanatomethyl-3,4,4-trimethylcyclohexyl isocyanate are other examples of triisocyanates useful for the purposes of this invention, as is methine-tris-(phenylisocyanate). Precursors of polyisocanate, such as diisocyanate, are also suitable for use in the present invention as substrates for the polyisocyanates.

The fluorocarbon alcohol, fluorocarbon thiol, or fluorocarbon amine reactant suitable for use in the present invention has the structure:

$$R_f—X—Y—H$$

wherein $R_f$ is a $C_{4-20}$ linear or branched fluorocarbon chain,

X is a divalent linking radical of formula $—(CH_2)_p$ or $—SO_2N(R_1)—CH_2CH_2—$, wherein p is 1 to about 20; and $R_1$ is an alkyl of 1 to about 4 carbon atoms; and Y is —O—, —S—, or $—N(R_2)—$ where $R_2$ is H or $R_1$.

More particularly $R_f$ is $C_qF_{(2q+1)}$ wherein q is 4 to about 20, or mixtures thereof. Preferred examples of $R_f—X—$ include the following: 1) mixtures of $F(CF_2)_q(CH_2)_n—$ wherein q is as previously defined and n is 1 to about 20, and 2) $F(CF_2)_qSO_2N(R_1CH_2CH_2—$ wherein q and $R_1$ are as previously defined. An example of mixture 1) includes the group of formula $F(CF_2CF_2)_nCH_2CH_2OH$, wherein n has values selected from 2, 3, 4, 5, 6, 7, 8, 9, and 10, said fluorochemical compounds being present in the proportions shown as compositions (i) or (ii):

TABLE 1

| | Composition by weight % | |
|---|---|---|
| N | (i) | (ii) |
| 2 | 0–3 | |
| 3 | 27–37 | 0–3 |
| 4 | 28–32 | 45–52 |
| 5 | 14–20 | 26–32 |
| 6 | 8–13 | 10–14 |
| 7 | 3–6 | 2–5 |
| 8 | 0–2 | 0–2 |
| 9 | 0–1 | 0–1 |
| 10 | 0–1 | 0–1 |

The alcohol, amine, or thiol reactant suitable for use herein is a straight chain or a branched alcohol, a straight chain or branched amine, or a straight chain or branched thiol. Primary alcohols are preferred since such alcohols are more readily reacted with the isocyanate groups than secondary or tertiary alcohols for steric reasons. Reactant 3 is a branched alcohol, amine, or thiol, or a mixture of branched and straight chain alcohols, amines, or thiols. Utilizing a proportion of branched chain alcohols, amines, or thiols provides a softer finish, probably by adding to the chain disorder. While the molar ratio of branched chain alcohol, amine, or thiol to straight chain alcohol, amine, or thiol is quiet broad, the molar ratio of branched chain to straight chain is preferably in the range 100:0 to 40:60.

Suitable straight chain alcohols, amines, or thiols have the structure $H(CH_2)_X—OH$, $H(CH_2)_X—NH_2$, or $H(CH_2)_X—SH$, wherein x is 12 to 20 and preferably 16 to 18, or mixtures thereof. Particularly preferred is the readily available stearyl alcohol (1-octadecanol) having x=18. Optionally, ethoxylates of alcohols may be used.

Suitable branched chain alcohols, amines, or thiols have the structure $C_yH_{(2y+1)}—CH_2—OH$, $C_yH_{(2y+1)}—CH_2—NH_2$, or $C_yH_{(2y+1)}—CH_2—SH$ wherein y is in the range 15 to 19, or mixtures thereof. An example is ISOFOL 18T, a mixture of branched chain alcohols comprising 2-hexyl- and 2-octyl-decanol, and 2-hexyl- and 2-octyl-dodecanol, available from Sasol North America, Inc., Houston Tex. Optionally, ethoxylates of alcohols may be used.

The reactant comprising the alcohol containing a sulfonic acid group or its salt (Reactant 4) contributes anionic sites to the product polymer, such that the polymer has self-dispersing properties and forms stable aqueous dispersions without added surfactants. The alcohol-sulfonate salt has the structure $$MO_3S—W—OH$$

wherein M is an alkali metal; ammonium; alkyl, dialkyl, trialkyl, or tetraalkyl ammonium; or hydrogen; and W is a straight or branched chain alkyl group containing from about 2 to about 10 carbon atoms, or an aryl or alkylaryl group containing one or more aromatic rings and 6 to about 11 carbon atoms.

Preferred is sodium 2-hydroxyethyl sulfonate, commercially available under the trivial name sodium isethionate. Other examples of such hydroxysulfonic acids are ammonium isethionate, 3-hydroxy-1-propanesulfonic acid and its sodium salt, 4-hydroxybenzene sulfonic acid and its sodium salt, sodium 4-hydroxy-1-naphthalene sulfonate, and sodium 6-hydroxy-2-naphthalene sulfonate.

The alcohol containing a sulfonic acid group or its salt (Reactant 4) is not necessarily fully incorporated into the polyurethane. Thus the amount of the alcohol containing a sulfonic acid group or its salt may be slightly lower than the amount added and the amount of crosslinking by the linking reagent will be higher.

The sulfonic acid groups or their salts used as Reactant 4 are advantageous over the sulfates used in the prior art. The sulfates are hydrolyzed at the low pH ranges used in leather treatments, while the sulfonates are not hydrolyzed at these pH ranges.

If reactants 1 to 4 are not present in sufficient quantities to consume all of the isocyanate groups, the remaining isocyanate groups are reacted with a multi-functional linking agent (Reactant 5), thereby linking two or more isocyanate-terminated molecules together and increasing the molecular weight of the product. Typically, a compound containing a hydroxy group is used as the linking agent. While water is the most commonly used linking agent, other multi-functional compounds such as glycols are also suitable for use herein. When a linking agent other than water is selected, a stoichiometric insufficiency is used, as discussed below. A fluorinated diol is also suitable for use herein, such as the structure of $$(HO—CH_2)_2C(CH_2—S—[CH_2]_2—C_8F_{17})_2$$

Such a fluorinated diol, clearly, acts a both a linking agent (Reactant 5) and as a fluorocarbon alcohol (Reactant 2). An example of such a diol is LODYNE 941, available from Ciba Specialty Chemicals, High Point, N.C.

The fluorinated urethanes used in the present invention are prepared in a suitable dry solvent free of groups that react with isocyanate groups. Organic solvents are employed. Ketones are the preferred solvents, and methylisobutylketone (MIBK) is particularly preferred for convenience and availability. A small proportion of a solubilizing aid such as dimethylformamide, dimethylacetamide, or N-methylpyrrolidone (e.g., 10% of the solvent) increases the solubility of the sodium hydroxysulfonate and is optionally used if incorporation of the hydroxysulfonate is too slow or is incomplete. The reaction of the alcohols with the polyisocyanate is optionally carried out in the presence of a catalyst, such as dibutyltindilaurate or tetraisopropyltitanate, typically in an amount of about 0.1–1.0%. A preferred catalyst is dibutyltindilaurate.

The ratio of reactants on a molar basis per 100 isocyanate groups is shown in Table 2 below:

TABLE 2

Reactant Ratios (as mole % based on total available isocyanate groups in Reactant 1)

| Reactant | Mole % Ratio Ranges | | | |
|---|---|---|---|---|
| | Broad | | Preferred | |
| | From | To | From | To |
| Fluoroalcohol or fluorothiol (Reactant 2) | 28 | 48 | 33 | 43 |
| Alcohol, amine, or thiol (Reactant 3) | 28 | 48 | 33 | 43 |
| Hydroxysulfonic acid or salt thereof (Reactant 4) | 1 | 20 | 3 | 5 |
| Total reactants less linking agent | 70 | 100 | 75 | 85 |

Thus the linking agent is 0 to 30, preferably 15 to 25. The ratio of straight and branched alcohols, amines, or thiols is as previously specified above in the description of Reactant 3.

Since the equivalent weights of Reactants 1–4 vary according to the specific reactants chosen, the amounts are necessarily calculated in molar ratios. Examples of specific polymer compositions showing weight ratios are shown in Table 3 using the various fluoroalcohol homologue distributions shown in Table 4.

TABLE 3

Weight Proportions of Polymer Reactants

| Component | Case 1 g (mole %) | Case 2 g (mole %) | Case 3 g (mole %) |
|---|---|---|---|
| Reactant 1, 62.7 g DESMODUR N-100 with 21.1% —NCO in each Case. | | | |
| Reactant 2, Fluoroalcohol | | | |
| as Distribution 1 in Table 3 below, or | 61.87 (40) | 58.78 (38) | 46.40 (30) |
| as Distribution 2 in Table 3 below, or | 56.17 (40) | 53.37 (38) | 42.13 (30) |
| as Distribution 3 in Table 3 below | 67.01 (40) | 63.65 (38) | 50.25 (30) |
| Reactant 3, Hydrocarbon Alcohols | 23.88 (28) | 32.40 (38) | 39.22 (46) |
| Reactant 4, Isethionic Acid | 0.93 (2) | 1.87 (4) | 9.34 (20) |
| Molar Total, Reactants 2–4 | (70) | (80) | (96) |

TABLE 4

Weight Distributions and Equivalent Weights of Fluoroalcohols of Formula F—($CF_2$—$CF_2$)$_n$—$CH_2$—$CH_2$—OH used in Table 3

| n | Distribution 1 | Distribution 2 | Distribution 3 |
|---|---|---|---|
| 2 | 0.43 | 0.76 | — |
| 3 | 32.46 | 47.38 | 1.92 |
| 4 | 31.86 | 30.92 | 51.93 |
| 5 | 19.23 | 14.00 | 29.34 |
| 6 | 9.86 | 4.96 | 12.08 |
| 7 | 4.11 | 1.55 | 3.45 |
| 8 | 1.55 | 0.38 | 1.04 |
| 9 | 0.48 | 0.05 | 0.24 |

TABLE 4-continued

Weight Distributions and Equivalent Weights of Fluoroalcohols of Formula F—($CF_2$—$CF_2$)$_n$—$CH_2$—$CH_2$—OH used in Table 3

| n | Distribution 1 | Distribution 2 | Distribution 3 |
|---|---|---|---|
| | Effective Fluoroalcohol Equivalent Weight | | |
| | 490.7 | 445.5 | 531.4 |

Fluorinated esters suitable for use in combination with fluorinated urethanes in the present invention are described by Dettre et al. in U.S. Pat. No. No. 4,029,585. These include fluoroalkyl esters of carboxylic acids of from about 3 to about 30 carbon atoms, wherein the fluoroalkyl portion of the ester is of formula $C_nF_{(2n+1)}(CH_2)_m$— wherein n is from about 3 to about 14 and m is 1 to about 3. The preferred fluorinated esters are prepared from the corresponding fluoroalkyl aliphatic alcohols of the formula $C_nF_{(2n+1)}(CH_2)_m$—OH wherein n is from about 3 to 14 and m is 1 to 3. Most preferred are esters formed from a mixture of the alcohols, in particular wherein n is predominantly 10, 8, and 6 and m is 2. These esters are formed by reacting the alcohol or mixture of alcohols with mono- or polycarboxylic acids which can contain other substituents and which contain from about 3 to about 30 carbons. In one method of preparing the esters, the alcohol is heated with the acid in the presence of catalytic amounts of p-toluenesulfonic acid and sulfuric acid, and with benzene, the water of reaction being removed as a co distillate with the benzene. The residual benzene is removed by distillation to isolate the ester. A representative group of esters so prepared, containing the fluoroalkyl group $C_nF_{(2n+1)}(CH_2)_m$ wherein n is 3 to 14 and m is 1 to 3, includes esters prepared by reacting the alcohol with acetic acid, octanoic acid, decanoic acid, lauric acid, palmitic acid, delta-chlorovaleric acid, oleic acid, linoleic acid, malonic acid, succinic acid, adipic acid, suberic acid, sebacic acid, dodecanedioic acid, tridecandioic acid acid, maleic acid, azelaic acid, itaconic acid, benzyl malonic acid, o-phthalic acid, d,l-camphoric acid, citric acid, and citric acid urethane.

The 2-perfluoroalkyl ethanols of the formula $C_nF_{(2n+1)}CH_2CH_2OH$ wherein n is from 6 to 14, and preferably a mixture of 2-perfluoroalkylethanols whose values of n are as described above can be prepared by the known hydrolysis with oleum of 2-perfluoroalkylethyl iodides, $C_nF_{(2n+1)}CH_2CH_2I$. The 2-perfluoroalkylethyl iodides can be prepared by the known reaction of perfluoroalkyl iodide with ethylene. The perfluoroalkyl iodides can be prepared by the known telomerization reaction using tetrafluoroethylene and thus each perfluoroalkyl iodide differs by —($CF_2CF_2$)— unit.

Particularly preferred for use in this invention are the fluorinated citrate urethanes, and an example of a preparation is as follows. A mixture of perfluoroalkylalkyl alcohols is used to prepare a mixture of fluorinated citrates. The perfluoroalkylalkyl alcohol mixture is heated and agitated with anhydrous citric acid. Esterification catalysts such as boric acid and phosphorous acid are employed. Water, eliminated in the esterification reaction, is removed by distillation or other suitable means until the analysis indicates the reaction is complete. The resulting ester is reacted with a diisocyanate, polyisocyanate, or mixture of polyisocyanates in the presence of a catalyst such as butyltintrichloride. After completion of the reaction, a solvent such as methylisobutylketone is added to give a solution of the fluorinated citrate urethane in the solvent. The fluorinated citrate urethane can be dispersed in water by conventional means.

The fluorinated citrate urethanes are also used in the present invention in the form of an aqueous dispersion, typically containing from about 35% to about 45% of the solid citrate urethane in the dispersion.

In the mixtures of dispersions of fluorinated urethanes and fluorinated citrate urethanes as used in the practice of the present invention, the weight ratio of urethane dispersion to citrate urethane dispersion is from about 1:0 to about 1:1.5 and preferably from about 1:0.6 to about 1:1.2.

It is important to emphasize that soil resistance and oil- and water-repellency are different properties and that repellency does not necessarily translate to soil-resistance, a fact that is sometimes not well understood. The increased soiling associated with silicone water-repellency additives was mentioned above.

While not wishing to be bound by theory, urethane polymers are generally considered harder and tougher than typical acrylate and methacrylate polymers. In practice, soiling is a process involving pressure contact. The Test Method 2 (Accelerated Soiling Drum Test, see below) used to evaluate leather in the Examples herein clearly used the impact of a combination of ball bearings and artificial soil to effect soiling of the leather surface. Soil can thus become more easily embedded in a softer repellent, such as an acrylic. In comparison, embedding of the soil in the harder and tougher fluorinated hydrophobic additives used in the present invention occurs to a markedly less extent. Soil that does not become embedded is usually more readily released.

The fluorinated hydrophobic additives used in the present invention provide soil-resistance in leather. The fluorinated hydrophobic additive, in the form of an aqueous emulsion or dispersion is added during the tanning process. While the aqueous dispersion of at least one fluorinated hydrophobic additive can potentially be added at any stage in the tanning processes, addition towards the end of the wet processing is preferred. Addition at the end of the tanning process in the bath or float prior to the final rinsing and drying is more preferred.

Leather making processes start with freshly flayed animal hides or more conventionally with pretreated hides, i.e., with hides that have been cured, freed of flesh and excess hair, and treated by chrome tanning or an equivalent process. Such tanned hides are referred to in the industry as pelts or wet blue hides, and the term "wet blue hide stage" is used herein to describe this stage in the overall tanning process. In such a typical process, the wet blue hides are washed and rinsed in lukewarm water to remove chemicals with which the hides have previously been treated. The next steps are buffering and character-building steps that equalize the pH of the leather and build desired characteristics such as suppleness into the hides.

Retanning of the hides is continued by treating them with additional character builders to enhance and impart additional desirable characteristics. The hides are then washed and refloated at a mildly elevated temperature to substitute a softening agent for fat removed from the pores of the hides in a previous process step or steps. In a typical application the refloat step is followed by treatment in a water-based solution, including dispersions, colloidal suspensions, and the like, as well as true solutions, of additional softening agents to optimize the feel of the leather and a dyeing step to impart the wanted color to the leather. Steps to fix the previously added chemical or additives in place follow this. Buffering for pH equalization and increase of the pH to an appropriate level are the next process steps. Then, the hides are washed, rinsed, and may be treated with an additive selected to impart handle of the leather into which the hides are being converted.

For washable leather, Scheen's tanning process as taught in U.S. Pat. No. 5,972,037 follows the tanning process steps and adds a hydrophobic waterproofing agent before the buffering for pH equalization step. Furthermore, the hides are treated with a hydrophobic silicone to promote waterproofing and washability; a second fixing step; and a final rinse of the processed hides. The term "additive addition stage" is used herein to describe the point in Scheen's process where the silicone hydrophobe additive was introduced. Scheen further points out that all of the steps are not necessarily employed in every application of the tanning process. For other tanning processes, the additive addition stage is the last float just prior to final rinsing and drying.

The fluorinated hydrophobic additive dispersions are added to the tanning bath in an amount sufficient to provide a fluorine content in the dried leather of at least 0.2 g fluorine/$m^2$, preferably at least 0.5 g fluorine/$m^2$, more preferably at least 1.0 g fluorine/$m^2$, and more preferably at least 2.0 fluorine/$m^2$. Costs increase with higher fluorine levels without significant additional benefit beyond about 10 g fluorine/$m^2$.

In practice, the amount of the fluorinated hydrophobic additive dispersion added to the bath at the additive addition stage is from about 1% to about 12% by weight based on the weight of the wet blue hide. The fluorinated hydrophobic additive dispersions typically contain 10% to 30% fluorinated components.

The bath conditions for impregnating the leather with the fluorinated additives of the present invention preferably maintain control over pH, temperature, and the time that the wet blue hide is in the bath. Bath temperature and duration of immersion are inter-related, and techniques to balance these are well known to those skilled in the art. The pH is from about 2.5 to about 4.0 and preferably from about 3.0 to about 3.5. The bath temperature is from about 30° C. to about 70° C., and preferably from about 50° C. to about 60° C. After the fluorinated additive is added to the float in the tanning drum at the additive addition stage, tumbling of the hides in the process solution is continued for a period of from about 5 to about 90 min., typically for about 15 to about 45 min. and most commonly for about 15 min. The formic acid or other fixing agent is then added to the float, preferably in three equal portions, typically at 5–10 minute intervals. Tumbling of the hides in the tanning drum is continued for a period of 15 to 30 min. and typically 15 minutes after the fixative is added to the float solution.

Leather is based on hides that are natural products and therefore a variable substrate. Methods to adjust bath conditions and concentration to accommodate such natural variations are well known to those skilled in the art.

The leather finishing processes are completed by draining the float solution from the tanning drum; rinsing the hides in room temperature water until clean to remove excess chemicals; and drying the clean hides. The process of the present invention requires only a single drying step and no post-tanning treatment of the leather. Such final steps are well known to those skilled in the art.

Leathers are commonly dyed. Dyes added to the tanning process do not affect the soil resistance properties of the present invention. The leather color may affect the perception of color change due to soiling, for instance a lighter versus a darker color, so the color of samples is noted in the tables in the Examples herein and comparisons are best made between leathers of the same color.

The present invention further comprises leather having soil resistance. Such leather is prepared by the method described above using the fluorinated additives described above. The leather has a fluorine content in the dried leather of at least 0.2 g fluorine/$m^2$, preferably at least 0.5 g fluorine/$m^2$, more preferably at least 1.0 g fluorine/$m^2$, and more preferably at least 2.0 fluorine/$m^2$. The penetration of the fluorinated hydrophobic additive into the leather enables the soil-resistance properties of the leather to survive scuffing. The method of the present invention is useful to make leather having excellent soil resistance. The leather of the present invention is useful in a variety of consumer products, including but not limited to, apparel, gloves, footwear, furniture, accessories, and other products where leather is typically employed

MATERIALS AND TEST METHODS

Commercially available split pigskin wet blue hide, was obtained from Jintex, Taipei, Taiwan, and was used throughout the examples to make leathers.

The silicone used in Comparative Examples was DENSODRIN S, available from Clariant Corp., Fair Lawn, N.J.

Fluorinated additive 1 was a dispersion of a fluorinated urethane, prepared according to Example 1.

Fluorinated additive 2 was a mixture a fluorinated urethane and a fluorinated citrate urethane, prepared according to Example 2.

The following tests are intended to measure the intrinsic water repellency and soil resistance of the substrate surface and not to simulate actual wear performance in the field.

Test Method 1—Color Measurement

A Minolta Chroma Meter CR-410 colorimeter (Minolta Corporation, Ramsey, N.J.) was used to grade the soiled leather samples, compared against a control (unsoiled) leather to measure the color difference ("Delta E" value). Details for measuring the Delta E values are provided in the AATCC TM-153 "Color Measurements for Textiles: Instrumental". The Delta E value measures the difference in color between two samples and is more sensitive than the human eye. The average person can distinguish between the colors of two objects with a Delta E measurement of 1.0 or more. A Delta E value of zero represents no color difference between two samples. A larger Delta E value indicates a larger color difference between two samples. Thus a lower Delta E represents less soiling and is better.

Test Method 2—Accelerated Soiling Drum Test.

Leather specimens were mounted onto the inside of a metal drum facing the center of the drum, using either 2-sided adhesive tape and/or mechanical clamps, until the inside surface was covered by leather for assessing accelerated leather soiling. Into the drum was then placed a volume of "dirty SURLYN ionomer resin pellets" and 250 mL volume of 5/16 inch (0.79 cm) ball bearings. "Dirty SURLYN ionomer resin pellets" are made by blending 1L SURLYN 8528 ionomer resin pellets with 20 g of synthetic soil (AATCC TM-123). SURLYN 8528 ionomer is an ethylene/methacrylic acid copolymer, partial sodium or zinc salt, and is available from E. I. du Pont de Nemours and Company, Wilmington, Del. The drum was then closed and rolled on a roller-type drum mill for 2.5 minutes in each direction. The leather samples were then removed from the drum. Test Method 1 was used to evaluate the soiling on the leather.

Test Method 3—Water Repellency (Drop Test).

Drops of standard test liquids are placed on the substrate surface and observed for wetting and contact angle. The compositions of the aqueous test liquids are shown in the Table 5 below. The water repellency rating is the highest-numbered test liquid that does not wet the substrate surface. Beginning with the lowest-numbered test liquid, 3 small drops are placed on the substrate surface in several locations. The drops are observed for 10 seconds from approximately a 45° angle. If the water does not wet the substrate around the edge of the drop and the drop maintains the same contact angle, a drop of the next higher-numbered test liquid is placed at an adjacent site on the substrate and again observed for 10 seconds. This procedure is continued until one of the test liquids shows obvious wetting of the substrate under or around the drop within 10 seconds, or until the drop fails to maintain the same contact angle between the substrate surface and the drop. The water repellency rating of the substrate is the highest-numbered test liquid that will not wet the substrate within a period of 10 seconds. Two of three drops satisfying the above criteria constitutes a "pass". Higher ratings indicate increasing water repellency.

TABLE 5

Water Repellency Test Liquids (Water Drop Rating)

| Test Solution # | Water/Isopropanol ratio* |
|---|---|
| 1 | 98/2 |
| 2 | 95/5 |
| 3 | 90/10 |
| 4 | 80/20 |
| 5 | 70/30 |
| 6 | 60/40 |
| 7 | 50/50 |
| 8 | 40/60 |
| 9 | 30/70 |
| 10 | 20/80 |
| 11 | 10/90 |
| 12 | 0/100 |

*% by volume.

EXAMPLES

Example 1

A flask was charged with 99.98 g of a solution of 62.7% by weight DESMODUR N-100 (a hexamethylene diisocyanate prepolymer available from Lanxess Corporation, Pittsburgh, Pa.) in methylisobutylketone, MIBK, (calculated 320 mmol —NCO), 1.94 g isethionic acid (13 mmol), 16.77 g stearyl alcohol (61 mmol), 16.76 g ISOFOL 18T (61 mmol, available from Sasol North America, Inc., Houston Tex.), and 57.68 g mixed 1,1,2,2-tetrahydroperfluoro-1-alkanols, predominately C8, C10, C12, and C14 with small amounts of C6, C16, and C18 (available from E. I. Du Pont de Nemours and Company, Wilmington, Del., 122 mmol). With stirring, this mass was heated to 48° C. and a solution of approximately 0.027 g dibutyltindilaurate in 1–2 mL of MIBK was added to the flask. The temperature of the reaction spontaneously rose to 76° C. from the heat of reaction. The reaction mass was then further heated to 130° C. and maintained at that temperature for 21–22 hours. After the addition of 2.33 g of deionized water to consume the remaining isocyanate functional groups and 104.41 g of MIBK, the reaction mass was held at 75° C. for 3 hours. This initial product was then emulsified with 408.15 g of deionized water, and the MIBK and some of the water was removed by distillation to give 477 g of a dispersion product that was determined to be 29.9% solids. This dispersion is designated herein as Fluorinated Additive 1.

Example 2

A mixture of 2-perfluoroalkylethanols was used to prepare a mixture of tris(2-perfluoroalkylethyl) citrates. The mixture of 2- perfluoroalkylethanols was such that in their perfluoroalkyl groups, $CF_3CF_2(CF_2)_k$, where k was 2, 4, 6, 8, 10, 12 and 14 in the approximate weight ratio of 1/33/31/18/8/3/1, and such a mixture had an average molecular weight of about 452. The 2-perfluoroalkylethanol (4306 kg) was combined with agitation at 70°+/−5° C. with anhydrous citric acid (562 kg). Thereafter granular boric acid (2.7 kg) and aqueous phosphorous acid (6.4 kg of a 70% solution) were added as catalysts. The temperature of the reaction mixture was increased over a 3–4 h period to 130°+/−5° C. with agitation. Agitation was continued for 23–24 h while removing water formed in the reaction between the 2-perfluoroalkylethanol and citric acid. When analysis indicated that the esterification was complete, the temperature of the reaction was reduced to 70°–80° C. and butyltintrichloride (5.9 kg) was added. The temperature was adjusted to 70°–75° C. and hexamethylene diisocyanate (255 kg) was added. The temperature was allowed to rise to 80°–86° C. and held at that temperature for about 6 h. Thereafter the temperature was increased to 92°+/−2° C. and the reaction mixture agitated at that temperature for 8 h. The reaction temperature was then reduced to 55°–75° C. and methylisobutylketone (2312 kg) was added to it. The reaction temperature was adjusted to 60°–70° C. and the mixture was agitated for 1–2 h. The product was a solution of the tris(2-perfluoroalkylethyl) citrate urethane in methylisobutylketone having a weight of 7003 kg which contained 4392 kg of a mixture of tris(2-perfluoroalkylethyl) citrate urethanes.

A mixture of tris(2-perfluoroalkylethyl) citrate urethanes (851 kg), prepared as above, were dissolved in methylisobutylketone (419 kg) prepared in the manner described above was emulsified with deionized water (1419 kg) and aqueous sodium dodecylbenzene sulfonate (85 kg of a 30% solution). The methylisobutylketone was then removed from the emulsion by vacuum distillation. The resulting dispersion was standardized to 40+/−1.5% of the citrate urethane, using deionized water. This dispersion was mixed with the dispersion of Example 1 and the mixture is designated herein as Fluorinated Additive 2.

Example 3

The tanning process was followed from the wet blue hide stage as described above and in U.S. Pat. No. 5,972,037. Wet blue hides were washed and rinsed. They were then immersed in a water float of 100% to 150% of wet blue weight and 1% by weight of the wet blue hide of sodium formate, and 0.75% by weight of the wet blue hide of sodium acetate were added as buffering agents. After buffering the hides were washed drained and refloated in water with at least 100% to 150% of wet blue weight. Then 6% by weight of the wet blue hide of TERGOTAN MC-N, and 4% by weight of wet blue hide of TERGOTAN EFB, each available from Clariant Corporation, Fair Lawn, N.J., were added as character builder agents to help build suppleness into the leather. After the hides were again drained washed, and refloated as previously, 4% by weight of the wet blue hides of DERMALIX C (also available from Clariant Corp.) was added as a softening agent. Dye was then added to achieve the desired color in the finished leather. This was followed by a fixing agent (formic acid) and retanning (chrome agents). After again draining, washing and refloating at a lower weight by tannage of 75%, OMBROPHOB M available from Clariant Corp. (10% by weight of the wet blue hide) was added as a waterproofing agent. After draining, washing and refloating to 100% to 150% of wet blue weight, the bath was then treated with 4% of a fluorinated additive dispersion based on the wet blue hide weight. The fluorinated dispersion was Fluorinated Additive 2. The pH was lowered to 3–3.5 with formic acid for fixation. The hides were finished conventionally by rinsing, pulling from the drum and drying at ambient temperatures. Oil and water repellencies were determined using Test Methods 1, 2, and 3. The results are shown in Table 6 below.

Examples 4–13

With the exception of Example 12, the procedure of Example 3 was followed except that 4% (based on the wet blue hide weight) of Fluorinated Additive 1 was added to the bath for Examples 5, 6, 11, and 13, while 4% (based on the wet blue hide weight) of Fluorinated Additive 2 was added to the bath for Examples 4, 7, 8, 9, and 10. Example 12 was obtained from a commercially available DOCKERS (Levi Strauss & Co., San Francisco, Calif.) jacket that had been treated by Fluorinated Additive 1 in a conventional tanning process. Water repellency and soil resistance were determined using Test Methods 1, 2, and 3. The results are shown in Table 6 below.

Comparative Example A

Comparative Example A was prepared as in Example 3 by the method as described in U.S. Pat. No. 5,972,037 using a commercially available silicone hydrophobe at 4% of wet blue hide weight (DENSODRIN S, see Materials). No fluorinated additive was used. The leather was tested using Test Methods 1, 2 and 3. The results are shown in Table 6 below.

Comparative Examples B, C, D, and E

For Comparative Examples B and C, commercially available leathers were obtained from Bemardo Fashions, LLC, (New York, N.Y.) that had been treated with SCOTCHGARD (3M Company, St. Paul, Minn.) fluorinated leather protectant. Samples for Comparative Examples D and E were obtained from AMI of San Francisco, Calif. and contained no fluorinated additives. The leather was tested using Test Methods 1, 2 and 3. The results are shown in Table 6 below.

Test Method 2 is a soiling test in which the soil partitions between the "dirty SURLYN ionomer resin pellets" and the leather samples in the drum. Thus it is most meaningful to compare results from a single test set. For example, a sample tested in a drum containing other leather samples that attract soil will appear to have less soiling than if the same sample is tested in a drum containing leather samples that are very soil resistant. Therefore the following interpretations will be limited to comparisons of samples within the same test set. Additionally, the color of leather substrates impacts the results. Dark substrates do not show soil as readily as light substrates. Thus, only comparison between leather samples of the same color will be discussed. To help visualization, data from different test sets and of different colors are separated by lines in Table 6.

TABLE 6

| Ex. | Additive Dispersion (a) | Test Set | Delta E, TM1 TM2* | Color | Water Repellency TM3* |
|---|---|---|---|---|---|
| 3 | 1 | 1 | 2.36 | Brown | 6 |
| 4 | 2 | 1 | 3.16 | Brown | 5 |
| A | Silicone | 1 | 6.12 | Brown | 4 |
| 5 | 1 | 2 | 6.09 | Tan | 8 |
| 6 | 1 | 2 | 5.68 | Tan | 7 |
| B | SCOTCHGARD | 2 | 11.31 | Tan | 10 |
| 7 | 2 | 3 | 2.94 | Tan | 4 |
| 8 | 2 | 3 | 1.80 | Tan | 5 |
| 9 | 2 | 3 | 2.34 | Tan | 4 |
| C | SCOTCHGARD | 3 | 8.86 | Tan | 10 |
| 10 | 2 | 4 | 1.52 | Tan | 6 |
| 11 | 1 | 4 | 4.63 | Tan | 6 |
| 12 | 1 | 4 | 3.06 | Tan | 4 |
| D | None | 4 | 14.00 | Tan | 3 |
| 13 | 1 | 4 | 10.04 | Light Green | 6 |
| E | None | 4 | 23.81 | Light Green | 3 |

Ex = example
*TM1, TM2, TM3: Results from Test Methods 1, 2, and 3 respectively. For Test Method 2, a lower Delta E value indicates superior soil resistance. For Test Method 3, a higher water repellency rating indicates superior water repellency.
(a) Additive Dispersions 1 and 2 are Fluorinated Additives 1 and 2 of Examples 1 and 2 respectively.

The soil resistance data in Table 6 (column labeled "Delta E, TM1 TM2") show that Fluorinated Additives 1 and 2 imparted improved soil resistance (lower Delta E values) to the leather substrates when compared to samples with no additive dispersion, or to those with silicone or other fluorinated additives. In addition, it can be seen that soil resistance was not necessarily provided by dispersion additives that provide good repellency (Table 6, "Water repellency TM3" column). This is most clearly demonstrated in test sets 2 and 3 in which the most repellent samples showed the poorest soil resistance properties.

What is claimed is:

1. A method of imparting soil resistance to leather comprising contacting said leather during tanning with a fluorinated hydrophobic additive comprising at least one fluorinated urethane which is a dispersion of a polymer having at least one urea linkage derived by reacting (1) at least one polyisocyanate, or mixture of polyisocyanates, (2) at least one fluorocarbon alcohol, fluorocarbon thiol, or fluorocarbon amine (3) at least one straight or branched chain alcohol, amine or thiol, and (4) at least one alcohol containing a sulfonic acid group or its salt, and then (5) optionally at least one linking agent, or a mixture of at least one said fluorinated urethane and at least one fluorinated ester.

2. The method of claim 1 wherein the fluorinated ester is a dispersion of a fluoroalkyl ester of a carboxylic acid, said acid having from about 3 to about 30 carbon atoms, wherein the fluoroalkyl portion of the ester is $C_nF_{(2n+1)}(CH)_m$— wherein n is from about 3 to about 14 and m is 1 to about 3.

3. The method of claim 1 wherein the mixture of a fluorinated urethane and fluorinated ester is a mixture of A) a dispersion of a polymer having at least one urea linkage derived by contacting (1) at least one polyisocyanate, or mixture of polyisocyanates, (2) at least one fluorocarbon alcohol, fluorocarbon thiol, or fluorocarbon amine of formula $R_f$—X—Y—H wherein $R_4$ is a $C_4$ to $C_{20}$ linear or branched fluorocarbon chain, X is a divalent linking radical of formula —$(CH_2)_p$ or —$SO_2N(R_1)CH_2CH_2$— wherein p is 1 to about 20, and $R_1$ is an alkyl of 1 to about 4 carbon atoms, and Y is —O—, —S—, or $N(R_r)$— wherein $R_2$ is H or $R_1$, (3) at least one straight or branched chain alcohol, amine or thiol, and (4) at least one alcohol containing a sulfonic acid group or its salt and then (5) optionally at least one linking agent, and B) a dispersion of a fluoroalkyl ester of a carboxylic acid, said acid having from about 3 to about 30 carbon atoms, wherein the fluoroalkyl portion of the ester is $C_nF_{(2n+1)}(CH)m$— wherein n is from about 3 to about 14 and m is 1 to about 3.

4. The method of claim 3 wherein the component B) is a dispersion of a polymer prepared by contacting a fluorinated alcohol with citric acid, and then with at least one polyisocyanate or mixture of polyisocyanates.

5. The method of claim 2 wherein the weight ratio of fluorinated urethane dispersion to fluorinated ester dispersion is from about 1 to 0 to about 1 to 1.5.

6. The method of claim 1 wherein the fluorinated hydrophobic additive contacted with the leather is in an amount or from about 1% to about 12% by weight based on weight of wet blue hide employed.

7. The method of claim 1 wherein the fluorinated hydrophobic additive contacted with the leather is an amount to provide at least about 0.2 g fluorine/$m^2$ in the dry leather.

8. The method of claim 1 wherein the fluorinated hydrophobic additive contacted with the leather is an amount that provides at least 0.5 g fluorine/$m^2$ in the dry leather.

9. The method of claim 1 wherein the contacting occurs during the tanning of the leather at the additive addition stage.

10. The method of claim 9 wherein the contacting during tanning is just prior to a final rinsing and drying step.

11. The method of claim 9 wherein the contacting is in an aqueous bath having a pH of from about 2.5 to about 4.0, at a temperature of from about 30° C. to about 70° C.

12. A leather treated to provide soil resistance by contacting said leather during tanning with a fluorinated hydrophobic additive comprising at least one fluorinated urethane which is a polymer having at least one urea linkage derived by reacting (1) at least one polyisocyanate, or mixture of polyisocyanates, (2) at least one fluorocarbon alcohol, fluorocarbon thiol or fluorocarbon amine, (3) at least one straight or branched chain alcohol, amine or thiol, and (4) at least one alcohol containing a sulfonic acid group or its salt, and then (5) optionally at least one linking agent, or a mixture of at least one fluorinated urethane and at least one fluorinated ester.

13. The leather of claim 12 wherein the fluorinated ester is a fluoroalkyl ester of a carboxylic acid, said acid having from about 3 to about 30 carbon atoms, wherein the fluoroalkyl portion of the ester is $C_nF_{(2n+1)}(CH)_m$— wherein n is from about 3 to about 14 and m is 1 to about 3.

14. The leather of claim 12 wherein the mixture of a fluorinated urethane and fluorinated ester is a mixture of A) a dispersion of a polymer having at least one urea linkage derived by contacting (1) at least one polyisocyanate, or mixture of polyisocyanates, (2) at least one fluorocarbon alcohol, fluorocarbon thiol, or fluorocarbon amine of formula $R_f$—X—Y—H wherein $R_f$ is a $C_4$ to $C_{20}$ linear or branched fluorocarbon chain, X is a divalent linking radical of formula —$(CH_2)_p$ or —$SO_2N(R_1)CH_2CH_2$— wherein p is 1 to about 20, and $R_1$ is an alkyl of 1 to about 4 carbon atoms, and Y is —O—, —S—, or $N(R_2)$— wherein $R_2$ is H or $R_1$, (3) at least one straight or branched chain alcohol, amine or thiol, and (4) at least one alcohol containing a sulfonic acid group or its salt, and then (5) optionally at least one linking agent, and B) a dispersion of a fluoroalkyl ester of a carboxylic acid, said acid having from about 3 to about 30 carbon atoms, wherein the fluoroalkyl portion of the ester is $C_nF_{(2n+1)}(CH)_m$— wherein n is from about 3 to about 14 and m is 1 to about 3.

15. The leather of claim 12 wherein the mixture is of

A) a dispersion of a polymer having at least one urea linkage derived by contacting (1) at least one polyisocyanate, or mixture of polyisocyanates, (2) at least one fluorocarbon alcohol, fluorocarbon thiol, or fluorocarbon amine (3) at least one straight or branched chain alcohol, amine or thiol, and (4) at least one alcohol containing a sulfonic acid group or its salt, and then (5) optionally at least one linking agent, and B) a dispersion of a polymer prepared by contacting a fluorinated alcohol with citric acid, and then with at least one polyisocyanate or mixture of polyisocyanates.

16. The leather of claim 12 which has a fluorine content of at least about 0.2 g fluorine/$m^2$ when the leather is dry.

* * * * *

UNITED STATES PATENT AND TRADEMARK OFFICE

CERTIFICATE OF CORRECTION

PATENT NO. : 7,160,480 B2
APPLICATION NO. : 11/063202
DATED : January 9, 2007
INVENTOR(S) : Andrew Hen Liu et al.

It is certified that error appears in the above-identified patent and that said Letters Patent is hereby corrected as shown below:

Col. 13, line 63, delete "$R_4$" and substitute therefor -- $R_f$ --.

Col. 14, line 1, delete "($R_r$)" and substitute therefor -- ($R_2$) --.

Col. 14, line 19, delete "amount or" and substitute therefor -- amount of --.

Signed and Sealed this

Twentieth Day of November, 2007

JON W. DUDAS
*Director of the United States Patent and Trademark Office*